US005974942A

United States Patent [19]

Dionne

[11] Patent Number: 5,974,942

[45] Date of Patent: Nov. 2, 1999

[54] EJECTION-ASSIST MECHANISM FOR AUTOMATIC FIREARMS

[75] Inventor: Sylvain Dionne, Mirabel, Canada

[73] Assignee: SNC Industrial Technologies Inc./Les Technologies Industrielles SNC Inc., Le Gardeur, Canada

[21] Appl. No.: 09/139,417

[22] Filed: Aug. 25, 1998

[51] Int. Cl.[6] ..... F41A 5/00; F41A 3/00

[52] U.S. Cl. ..... 89/194; 89/183; 42/25

[58] Field of Search ..... 89/194, 4.5, 183; 45/25, 76.01

[56] References Cited

U.S. PATENT DOCUMENTS

| | | | |
|---|---|---|---|
| 2,809,564 | 10/1957 | Pope | 89/128 |
| 2,851,929 | 9/1958 | Milroy, Jr. | 89/194 |
| 3,619,928 | 11/1971 | Martin et al. | 42/25 |
| 4,163,334 | 8/1979 | Tollinger | 42/25 |
| 4,265,043 | 5/1981 | Rowlands | 42/25 |
| 5,024,016 | 6/1991 | Smith | 42/25 |
| 5,341,587 | 8/1994 | Phillips, Jr. | 42/68 |

*Primary Examiner*—Charles T. Jordan
*Assistant Examiner*—Jeffrey Howell
*Attorney, Agent, or Firm*—David J. French

[57] ABSTRACT

A barrel for an automatic firearm which cycles on recoil action is provided with a transverse pin extending across the top of the rearward portion of the chamber. This pin nests within the extraction groove of a cartridge casing during firing. On cycling, the transverse pin deflects the spent case downwardly towards an ejector which effects ejection of the casing.

1 Claim, 3 Drawing Sheets

EJECTION-ASSIST MECHANISM FOR AUTOMATIC FIREARMS

FIELD OF THE INVENTION

This invention relates to the field of firearms and provisions for modifying semi-automatic firearms for training purposes. In particular, it relates to reliable ejection of ammunition from firearms that have been modified to straight blow-back action so that they can fire low-energy ammunition.

BACKGROUND TO THE INVENTION

In military and police firearms applications almost all of the ammunition consumed is used for training. For some training purposes, however, normal ammunition is not adequate. An alternative type of known training ammunition, represented by U.S. Pat. No. 5,359,937 (adopted herein by reference), fires a low-mass projectile relying on a special, low-energy cartridge designed to provide cycling of suitably-modified, recoil-operated automatic weapons.

An advantage of the low-energy training ammunition is that it has a shorter range and lower penetration capacity than standard ammunition. This permits use of smaller, less secure firing ranges as training facilities. If standard ammunition were accidentally employed in these facilities, unexpected dangers would arise from the increased striking power and range of such standard ammunition.

The weapon modifications required to permit cycling while firing low-energy training ammunition generally include replacing or modifying the barrel, and sometimes replacing or adding certain other components, depending on the weapon involved. These modifications also take safety into consideration. For example, in 9 mm automatic firearms, the caliber of the substitute barrel may be smaller than the diameter of the projectiles in standard 9 mm ammunition. If an attempt is made to chamber a standard round in such a training-adapted firearm, the design of the chamber and barrel will not normally permit entry of the standard projectile. This ensures that such modified weapons cannot fire standard, live ammunition.

The low-energy cartridge represented by U.S. Pat. No. 5,359,937, in combination with a substitute training barrel, allows normal recoil and cartridge case ejection through a blow-back action. Such a system, when firing appropriate marking cartridges, makes up an effective close-range, force-on-force training system. Hits, which are non-lethal, are denoted by red, blue or other coloured marks. This system enhances the realism and training value of interactive scenario tactical training because it allows trainees to use their service weapons in a representative manner in exercises simulating, for example, counter-terrorism, close quarters combat, urban fighting, protection of dignitaries, trench clearing, and fighting in wooded areas.

When firing standard ammunition, with its abundant associated energy, it is necessary in many weapons, particularly handguns, to lock the barrel to the slide during the beginning of their rearward motion for a period long enough for the projectile to exit the barrel muzzle while the breech is still closed. This allows the chamber pressure to drop before the breech opens to eject the spent cartridge case. A locking mechanism couples the slide and barrel together for the first portion of the recoil, and then releases the slide. Upon unlocking, the slide continues its rearward travel while the barrel stops in the proper position to receive the next round from the magazine to be chambered.

Associated with the barrel locking and unlocking with the slide in a standard weapon, there may also be an up-and-down vertical movement of the chamber end of the barrel. This pivoting motion may be caused by a cam located under the barrel. When in battery, the barrel is in its most upward position such that the center of the primer of the chambered round is aligned with the firing pin. After firing, the chamber end of the barrel drops to its most downward position, which brings it in line with the ejector.

In a training barrel it is necessary to omit this barrel-locking mechanism and, by so doing, the recoil action becomes pure blow-back with no up-and-down motion of the barrel. This must be done because there is not enough energy in low-energy training cartridges to precipitate sufficient recoil to unlock the barrel and the slide in their standard configurations. A training barrel of the type addressed by this invention is similar in most aspects to the standard barrel for a particular pistol with a barrel locking mechanism, but is modified, in part, by removing this locking mechanism, which holds the barrel and the slide together for the first portion of the recoil cycle.

In some 9 mm pistols, after the locking mechanism has been removed and the barrel pivoting/cam system deactivated so that the weapon can fire low-energy ammunition as represented by U.S. Pat. No. 5,359,937, the training barrel is out of line with respect to the ejector during the recoil cycle. Since barrel pivoting is no longer present, the barrel chamber must be positioned in such a way that the cartridge can be fed easily into the chamber and also be in line with the firing pin for firing. Therefore, due to this feature (of being in line with the firing pin) the chamber is out of line with the ejector in the modified weapon. This misalignment means that the spent cartridge case may not come into proper contact with the ejector, thereby causing jamming due to failure to eject.

It is, therefore, an objective of this invention to provide a training barrel system for this class of firearms that will ensure reliable ejection of the spent case upon firing.

The invention in its general form will first be described, and then its implementation in terms of specific embodiments will be detailed with reference to the drawings following hereafter. These embodiments are intended to demonstrate the principal of the invention and the manner of its implementation. The invention in its broadest and more specific forms will be further described, and defined, in each of the individual claims which conclude this specification.

SUMMARY OF THE INVENTION

This invention is directed to an automatic pistol adapted to fire low-energy training ammunition by the substitution of a training barrel that omits the barrel-locking feature normally present, especially in combination with a barrel pivoting/cam system. It provides a system for orienting the spent cartridge case such that it will strike the ejector during the recoil cycle, thereby being knocked out of the weapon, while in no way affecting the alignment of the firing pin with the primer when the weapon is in battery (i.e., ready to fire).

According to the invention, a firearm is provided with a slide and a training barrel which at no time are locked together, nor is there any up-and-down movement of the barrel during the firing cycle. The firearm into which this training barrel is to be installed has an ejector member located within the firearm frame rearwardly of the barrel at a position that is beneath the geometric rearward extension of the cartridge casing when a cartridge is chambered in the barrel.

The training barrel of the invention is similar to a standard barrel in that it includes a barrel with a bore and a chamber for receiving a cartridge which has an extraction groove at the rearward end of the cartridge casing; but differs from a standard barrel in that it includes an ejection cartridge case deflector in the form of an ejection-assist pin mounted in the wall defining the chamber and positioned to:

a) permit chambering of a round in the normal manner;

b) nest within the extraction groove on the cartridge casing when the weapon is in battery; and c) lie in the path of the outer periphery of the cartridge casing during ejection whereby, on ejection of the cartridge casing, the casing is deflected downwardly by contact with the cartridge case deflector so as to be directed towards the ejector for subsequent ejection.

The ejection-assist pin of the invention passes laterally through the chamber wall to protrude slightly into the chamber volume and partially engage with the extraction groove on a cartridge casing when the weapon is in battery. This pin may bear against the casing during chambering of the cartridge but does so to such a minimal degree that a round is able to be chambered in the normal manner. Upon extraction of the spent casing, the pin interferes with the exiting motion of the cartridge casing, deflecting it downwardly, towards the ejector. Upon striking the ejector, the spent casing is thrown through the ejection port in the slide in the normal manner.

As the cartridge is being chambered, it comes into contact with, but is not impeded by, the pin until, when fully chambered, the pin is fully seated and centered in the extraction groove. Thus, when the weapon is in battery, the cartridge to be fired is in exactly the same position as it would be if the pin were not present.

After firing, as the spent case commences to move rearwardly out of the chamber, it passes by the pin and, in so doing, is canted downwards so that its line of motion is deflected to bring it into contact with the ejector. If this downward cant were not imparted to the spent case by the pin, the line of motion of the case would be too high, or above, the ejector, thereby jeopardizing reliable ejection of the case from the weapon. In such instances, the likelihood of weapon jamming is high.

One way of locating the pin in the chamber wall is to drill lateral holes of the appropriate size on each side of the chamber wall, and then to insert and secure a high-strength metal pin through these holes, one end of the pin in one hole and the other end of the pin in the other hole.

Although a transverse pin is preferred, any form of protrusion that serves as a cartridge-case deflector while the spent casing is being extracted from the chamber may be employed.

The foregoing summarizes the principal features of the invention. It may be further understood by the description of the preferred embodiments, in conjunction with the drawings, which now follow.

SUMMARY OF THE FIGURES

FIG. 1 depicts a fully-chambered, low-energy cartridge present in the barrel chamber but without the feature of the invention being present.

DESCRIPTION OF THE PREFERRED EMBODIMENT

Figure 1:
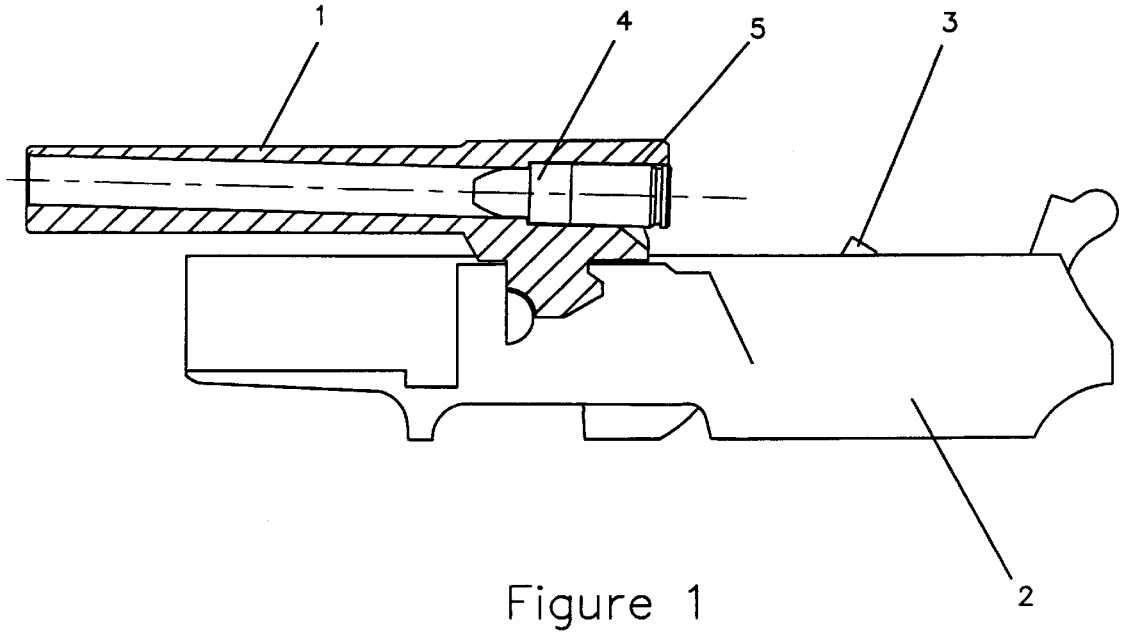
FIG. 1 is a partial cutaway, and cross-sectional side view of a training barrel without an ejection-assist pin, showing part of the normal frame of a 9 mm semi-automatic pistol but modified by the presence of a training barrel to fire low-energy ammunition, as represented by U.S. Pat. No. 5,359,937.
Figure 2:
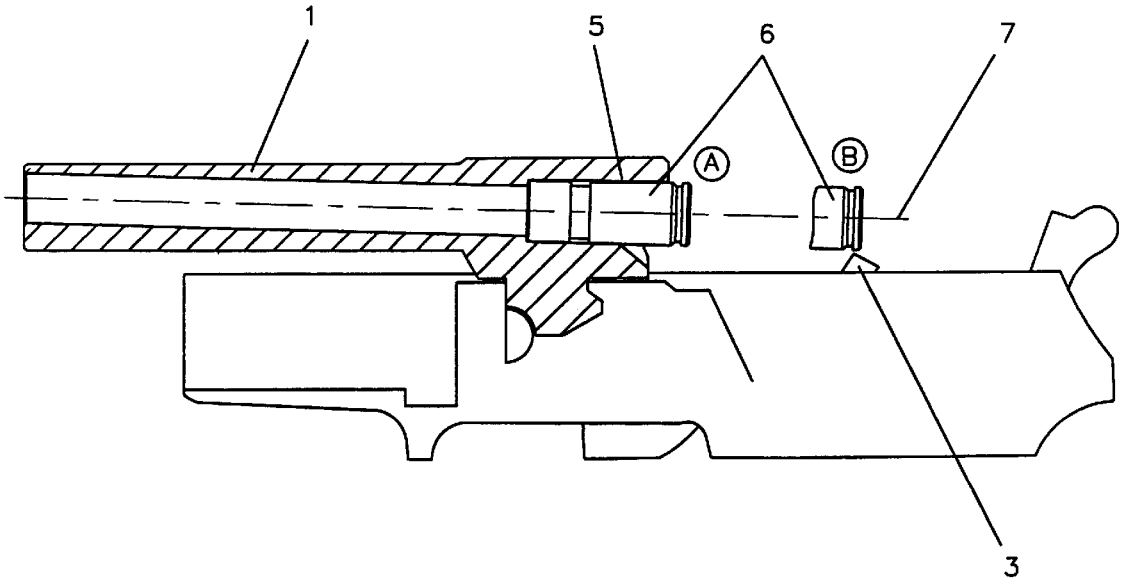
FIG. 2 is the same view as in FIG. 1 without the feature of the invention present after the weapon has been fired, first showing the spent cartridge case emerging from the chamber at Position A, and then showing the spent cartridge case passing over the top of the ejector at Position B.

In FIG. 1 a training barrel 1 is shown mounted in a 9 mm standard frame 2 containing ejector 3, with a fully-chambered low-energy training cartridge 4, as represented by U.S. Pat. No. 5,359,937, in chamber 5. If the slide (not shown, for the sake of clarity) were present, the weapon would be in battery. After the weapon is fired, spent cartridge case 6 begins to move rearward out of chamber 5 with the aid of an extractor (not shown), as illustrated at Position A of FIG. 2. Because the centerline 7 of barrel 1, along which spent case 6 moves, is too high in relation to the top of ejector 3 without the feature of the invention present, the expended case 6 passes over ejector 3 without coming into contact with it, as illustrated at Position B of FIG. 2.

Figure 3:
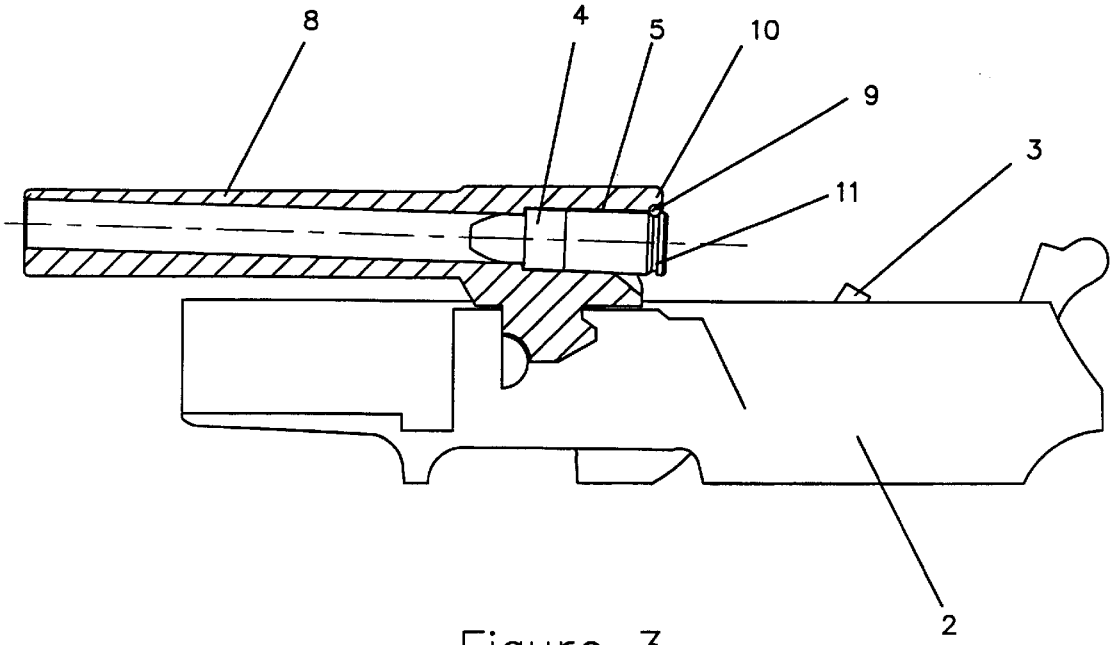
FIG. 3 is a partial cutaway, cross-sectional side view of the training barrel with the ejection-assist pin of the invention present showing part of the frame of a 9 mm semi-automatic pistol modified by the presence of the training barrel to fire low-energy ammunition, as represented by U.S. Pat. No. 5,359,937, and having a fully-chambered low-energy cartridge present in the chamber.
Figure 4:
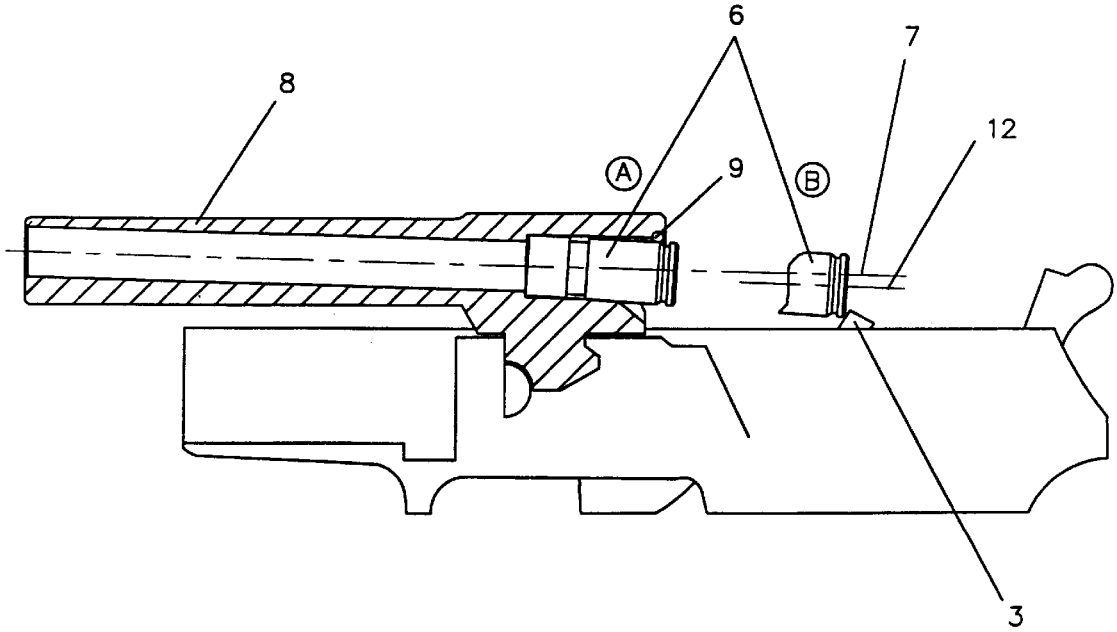
FIG. 4 is the same view as in FIG. 3 after the weapon has been fired, first showing the spent cartridge case emerging from the chamber at Position A, and then showing the spent cartridge case coming into contact with the ejector at Position B.

In FIG. 3 a training barrel 8 containing an ejection-assist pin 9 in chamber wall portion 10 is shown mounted in a 9 mm standard frame 2 containing ejector 3, with a fully-chambered low-energy training cartridge 4, as represented by U.S. Pat. No. 5,359,937, in chamber 5. The ejection-assist pin 9 is centered in the extraction groove 11 of low-energy cartridge 4 when the cartridge is fully chambered. If the slide (not shown) were present, the weapon would be in battery. After the weapon is fired, spent cartridge case 6 begins to move rearward out of chamber 5 with the aid of an extractor (not shown) at the same time as being forced downward slightly by ejection-assist pin 9, as illustrated in Position A of FIG. 4. The centerline 12 of expended case 6 is thereby tilted sufficiently downwards with respect to the centerline 7 of training barrel 8 so that movement of spent case 6 along its path 12 will bring spent case 6 into contact with ejector 3, as illustrated at Position B of FIG. 4.

Figure 5A:
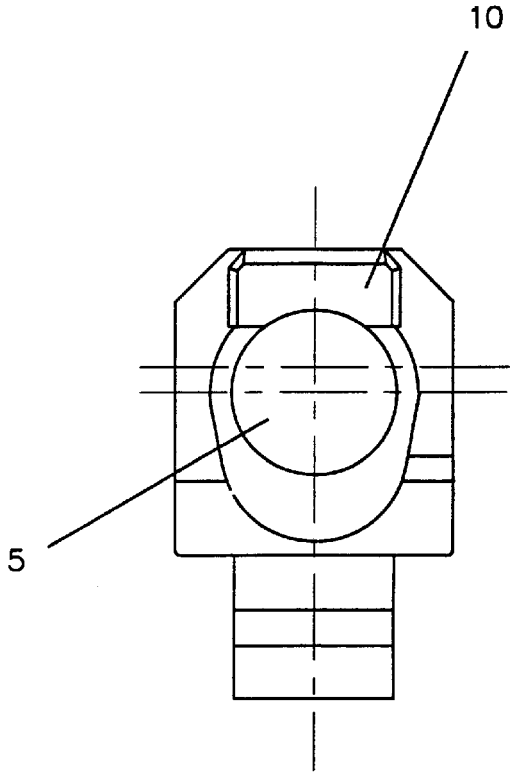
FIGS. 5A and 5B are rear views of a training barrel, first without an ejection-assist pin in FIG. 5A, and then with an ejection-assist pin present in FIG. 5B.
Figure 5B:
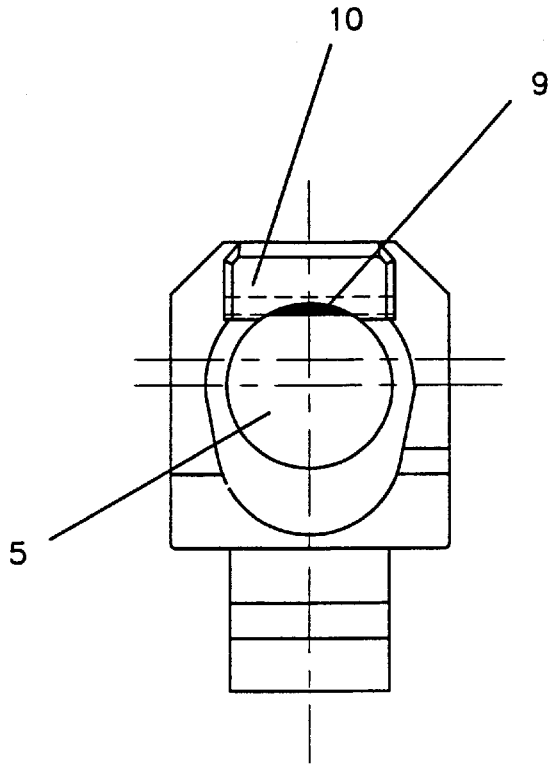
Figure 6:
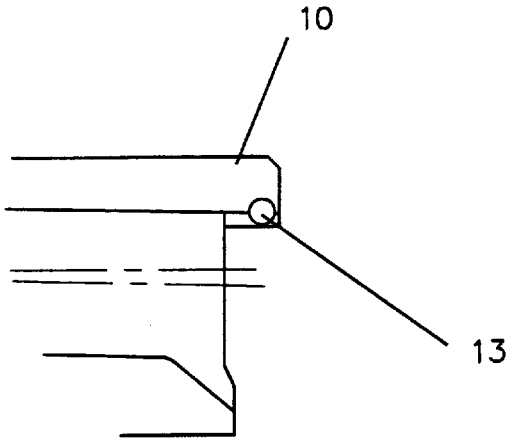
FIG. 6 is a side view of the chamber end of a training barrel with an ejection-assist pin present.

FIGS. 5A, 5B show the entrance to chamber 5 and chamber wall portion 10 without the presence of an ejection-assist pin in FIG. 5A, and with the presence of ejection-assist pin 9 installed in chamber wall portion 10 in FIG. 5B. FIG. 6 shows a side view of FIGS. 5A, 5B indicating the location of ejection-assist pin hole 13 in chamber wall portion 10. The ejection-assist pin 9, which has a diameter of approximately 0.0625 inch for 9 mm pistols, may be press fitted into ejection-assist pin hole 13; it may also be a loose fit and held by staking.

The functioning of the subject ejection-assist mechanism has been tested many hundreds of times in Sig P225 (P6)

pistols with complete success and reliability. While this ejection-assist mechanism is particularly suited for the training barrel for the Sig P225 (P6), it is also suited to training barrels destined for the Sig P226, Sig P229, Glock 17, Glock 19 and Glock 22 weapons as well as other automatic firearms that fire low-energy ammunition as represented by U.S. Pat. No. 5,359,937 or any other type of low-energy ammunition, including blanks, that require guidance during extraction to ensure ejection.

CONCLUSION

The foregoing constitutes a description of specific embodiments showing how the invention may be applied and put into use. These embodiments are only exemplary. The invention in its broadest and more specific aspects is further described and defined in the claims which now follow. These claims, and the language used therein, are to be understood in terms of the variants of the invention which has been described. They are not to be restricted to such variants, but are to be read as covering the full scope of the invention as is implicit within the invention and the disclosure that has been provided herein.

The embodiments of the invention in which an exclusive property are claimed as follows:

1. A pistol barrel having a chamber for receiving a cartridge with an extraction groove on the cartridge case, said chamber being surrounded by a chamber wall wherein the chamber is provided with a cartridge case deflector in the form of a transversely mounted pin spanning a portion of the upper rearward portion of the chamber and seated at its respective ends in the chamber wall, said pin being positioned at a location to interfit with the extraction groove on a cartridge case when the cartridge is fully inserted into the chamber.

* * * * *